US005284069A

United States Patent [19]

Wellman

[11] Patent Number: 5,284,069

[45] Date of Patent: * Feb. 8, 1994

[54] BALL LOCK PUNCH RETAINER

[75] Inventor: Charles G. Wellman, Novi, Mich.

[73] Assignee: AIP inc., Troy, Mich.

[ * ] Notice: The portion of the term of this patent subsequent to Jan. 26, 2010 has been disclaimed.

[21] Appl. No.: 990,872

[22] Filed: Dec. 15, 1992

Related U.S. Application Data

[63] Continuation of Ser. No. 708,696, May 31, 1991, Pat. No. 5,181,438, which is a continuation-in-part of Ser. No. 506,773, Apr. 10, 1990, Pat. No. 5,038,599.

[51] Int. Cl.[5] ..... B21K 5/20

[52] U.S. Cl. ..... 76/107.1; 72/481; 83/698; 279/30

[58] Field of Search ..... 72/46, 462, 481; 83/686, 698; 279/22, 30, 76, 79; 76/107.1

[56] References Cited

U.S. PATENT DOCUMENTS

| | | | |
|---|---|---|---|
| D. 218,910 | 10/1970 | Gargrave . | |
| 2,089,166 | 8/1937 | Reichhardt | 279/30 |
| 2,105,391 | 1/1938 | Almdale . | |
| 2,160,676 | 5/1939 | Richard | 279/76 |
| 2,166,559 | 7/1939 | Richard | 279/30 |
| 2,348,380 | 5/1944 | Graham | 279/76 |
| 2,580,930 | 1/1952 | Kost | 279/79 |
| 3,126,776 | 3/1964 | Whistler, Sr. et al. | 83/13 |
| 3,176,998 | 4/1965 | Parker | 279/76 |
| 3,563,124 | 2/1971 | Gargrave | 83/698 |
| 3,589,226 | 5/1971 | Shadowens, Jr. | 83/143 |
| 4,558,620 | 12/1985 | Wallis | 83/698 |

OTHER PUBLICATIONS

Techniques of Pressworking Sheet Metal, An Engineering Approach to Die Design, second edition, Prentice-Hall, Inc., Englewood Cliffs, N.J., 1974 pp. 342-344.

*Primary Examiner*—Roscoe V. Parker
*Attorney, Agent, or Firm*—Dykema Gossett

[57] ABSTRACT

An improved punch retainer is disclosed in which a backing plate extends over a relatively large surface area to dissipate force from a punch. A punch retainer body and the tacking plate are permanently connected to each other and include passages which are finally ground after the two have been permanently connected. With this arrangement, it is ensured that passages within the backing plate and retainer body are all properly aligned during formation of the punch retainer. Since the backing plate dissipates force over a relatively large surface area, the punch retainer may be used in heavier applications than prior art punch retainers. A spring passage may be closed off by a seal received in the backing plate, allowing the use of standard springs. In a method according to the present invention, a dowel passage in the backing plate is finally ground such that it is centered on the center line of the punch within the retainer. The punch is of a slightly smaller outer diameter than the inner diameter of the punch retainer passage and has a center line which is slightly offset from the center line of the punch retainer passage. Thus, by ensuring that the dowel passage in the backing plate is finally ground such that its center line is coaxial with the center line of the punch, it is ensured that the punch is more accurately positioned on a punch die shoe. Parts formed by the inventive punch retainer are more accurate than those formed by prior art punch retainers.

13 Claims, 2 Drawing Sheets

BALL LOCK PUNCH RETAINER

This is a continuation of co-pending application Ser. No. 07/708,696 filed on May 31, 1991 and now U.S. Pat. No. 5,181,438 which is a continuation-in-part of U.S. patent application Ser. No. 07/506,773 which was filed on Apr. 10, 1990 and now U.S. Pat. No. 5,038,599.

BACKGROUND OF THE INVENTION

The present invention relates to an improvement in punch retainers for use in a punch and die assembly.

Punch retainers are used in the prior art to retain a punch in a die shoe when the punch is moved to form an aperture in a sheet of metal. Typically, ball lock punch retainers spring-bias a ball into a notch in the punch. In many prior art retainers a backing plate is attached, suing screws or other non-permanent methods, to a retainer body to dissipate reactive forces from the punch when it is forced into a piece of metal, to form an aperture in the metal. These prior art retainers include a number of passages through which dowels extend to properly align the punch retainer with an upper die shoe of a punch and die assembly. Problems are encountered with this type of prior art retainer since the retainer body is connected to the backing plate after formation of the individual parts. The various passages that extend through the retainer body and the backing plate are often improperly aligned and require close attention by an operator to assemble the punch retainer to a die shoe, which is inefficient. There is often waste since a particular backing plate may not be utilized with a particular punch retainer if the passages in the two can not be properly aligned.

Other problems encountered with the use of backing plates include the fact that the punch is normally slightly smaller in diameter than the punch passage. The passages in the backing plate which are aligned with the punch passage are typically formed in an attempt to center them on the punch passage. As stated above, the prior art cannot always achieve this goal. Even if it did achieve the goal, however, the punch itself is smaller than the punch passage and its center is typically not aligned with the center of the punch passage. Thus, forming the center of the dowel passage in the backing plate such that it is centered with the punch passage does not ensure that the dowel passage is centered on the punch. In fact, it ensures the punch passage is not centered on the punch if the punch retainer is a ball lock type wherein the punch is biased. This creates problems with positioning of the punch, since the dowel passage in the backing plate is used to position the punch retainer on the upper die shoe. In use, a ball biased by a spring typically forces the punch against an outer face of the punch passage such that its center is off-center from the center of the punch passage. Thus, the center line of the dowel passage in the backing plate is typically off-center from the center line of the punch, and the punch is thus not precisely positioned on the upper die shoe.

Further, since the position of the punch on the upper die shoe is determined by the position of the dowel pin extending through the dowel passage, it is important that the dowel passage be accurately positioned relative to the punch. This goal is further made difficult due to the fact that the manufacturing tolerances in forming the punch retainer passage, the dowel passage, the outer diameter of the punch itself, and in securing the backing plate to the retainer body, in combination with the above-discussed problem, all build up to result in a composite inaccuracy that may result in the punch being out of position relative to the upper die shoe by an undesirably large amount. This could result in the parts that are formed by the punch having apertures formed at locations away from a desired location.

Some prior art punch retainers attempt to solve some of these problems by eliminating the backing plate. An example of such a prior art retainer is illustrated in U.S. Pat. No. 3,563,124. In this patent, a plug is utilized in place of a backing plate to dissipate the force received from the punch. The force-dissipating plug must be aligned with the rear of the punch retainer passage so that the reactive force transmitted into the punch will be transmitted into the plug. This patent addressed the alignment problem inherent in the previously discussed prior art by having a dowel aligned with the punch retainer passage extend through the plug and into the die shoe. By eliminating the backing plate, the problem of achieving a number of properly aligned passages through both a retainer body and a backing plate is reduced. A similar device is shown in U.S. Pat. No. 3,589,226.

Problems are still encountered with this type of punch retainer. The forces that must be dissipated from the punch are often of relatively large magnitude, and the plugs disclosed in the above-mentioned patents extend for a relatively small surface area. These plugs sometimes may not adequately dissipate a force, since they do not extend over an adequate surface area.

In addition, prior art punch retainers are also impractical since it is difficult to secure the spring which biases the ball into a spring passage. Special springs are often required which are more expensive than standard springs.

It is an object of the present invention to disclose a punch retainer which utilizes a backing plate such that an adequate surface area is achieved for force-dissipating means; at the same time not requiring alignment of passage within a retainer body and a backing plate when attaching the punch retainer to a die shoe. In addition, the present invention discloses a punch retainer that doe snot require special springs to bias the ball into the punch.

SUMMARY OF THE INVENTION

The present invention discloses a punch retainer having a punch retainer body integrally connected to a backing plate by welding, riveting, adhesives, chemical bonding, or any other permanent connections. The passages within the backing plate and the retainer body are finally ground after the two have been integrally attached to ensure that the passages are aligned. The backing plate also includes a spring hole providing access to a spring passage. The spring hole is normally sealed by a screw or plug. By sealing the spring hole, standard springs without special attachment structure can be utilized.

In a preferred embodiment of the present invention, a punch is retained within a punch retainer passage in a pentagonal-shaped retainer body. The backing plate overlies the punch retainer passage and the punch abuts the backing plate. A dowel passage, of smaller diameter than the punch retainer passage, is aligned above the punch in the backing plate, and receives a dowel to properly position the punch retainer upon a die shoe. Since the dowel passage is of smaller diameter than the punch retainer passage, a force transmitted from the punch rearwardly is passed into the backing plate. The backing plate is preferably of approximately the same shape as the retainer body, and includes a surface area approximately equal to the surface area of the retainer body, to provide sufficient area for dissipating the force.

In forming the punch retainer of the present invention, the backing plate and the retainer body are initially formed into their general shape. They are then permanently connected, such as by welding or riveting. Passages within the two are then finally ground such that they are properly aligned. The final punch retainer can then be connected to a die shoe.

Further the dowel passages through the backing plate are finally ground such that they are centered on an approximate center line of the punch. This approximate center line of the punch is preferably determined by inserting a model punch into the punch retainer passage, biasing the punch relative to the punch retainer passage to the position a punch will typically be in during operation of the punch retainer, and finally grinding the dowel passage in the backing plate such that it is centered on the center line of the model punch. This method eliminates inaccuracies in the position of the punch due to manufacturing tolerances in forming the dowel passage in the backing plate, the inner diameter of the punch passage, the outer diameter of the punch itself, and further forming the punch passage in an attempt to center it on the punch retainer passage.

The model punch used to determine the center line for the dowel passage in the backing plate is preferably formed such that it is in the middle of an accepted tolerance range for the punch used in the production punch retainer bodies. Thus, when the center line of the dowel passage in the backing plate is finally ground to the center line of the model punch, the buildup of manufacturing tolerances due to inaccuracies in the size of the various members are largely eliminated. Inaccuracies due to the actual position of the punch centerline which is offset from the center line of the punch retainer passage is also eliminated. Thus, by forming the dowel passage in the backing plate along a center line coaxial with an idealized center line of the punch, one achieves a more accurate positioning of the punch on the upper die shoe. This reduced inaccuracies in the parts formed by the punch.

In one preferred method according to the present invention, a model punch is positioned on a machine such that a cutting tool grinds to the actual center line of the model punch. The model punch is preferably chosen to have an outer diameter which is in the middle of an acceptable tolerance range for the punches which will actually be used in the production punch retainers. A punch retainer body having a backing plate already attached is positioned over the model punch. A spring-bias member biases the punch retainer body relative to the model punch such that the model punch is in a position which approximates the position that an actual punch will be biased to by the spring-biased ball in the production punch retainer. The cutting tool then finally grinds the dowel passage in the backing plate such that it is coaxial to the center line of the model punch.

When a shaped punch is utilized, a diamond pin passage may be formed in the backing plate such that the punch may be properly radially positioned upon the punch shoe. In the present invention the diamond pin passage is formed in the backing plate, while a diamond pin clearance passage is formed in the retainer body. In the prior art, the clearance passage was formed in the backing plate, while the pin passage was formed in the retainer body.

These and other objects and features of the present invention will be understood from the following specification and drawings, of which the following is a brief description.

DETAILED DESCRIPTION OF A PREFERRED EMBODIMENT

Figure 1:
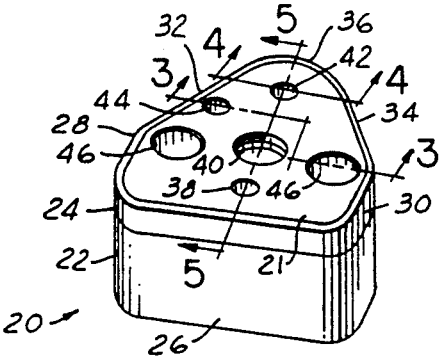
FIG. 1 is a top perspective view of a punch retainer according to the present invention.

Punch retainer 20 has a top face 21, illustrated in FIG. 1, and retainer body 22 with integrally connecting backing plate 24. Punch retainer 20 is of a generally pentagonal-shape and is defined by back 26, opposed rear side portions 28 and 30, and opposed front side portions 32 and 34, which extend inwardly to tip 36. Top face 21 has diamond pin passage 38, spring hole 40, dowel pin passage 42, second dowel pin passage 44, and two cap screw passages 46.

Figure 2:
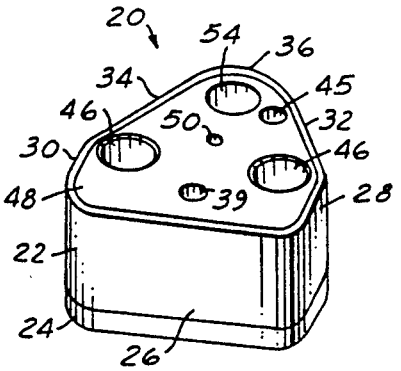
FIG. 2 is a bottom perspective view of a punch retainer illustrated in FIG. 1.

FIG. 2 shows a bottom face 48 of punch retainer 20. Bottom face 48 includes access hole 50, punch retainer passage 54, dowel pin clearance passage 45, diamond pin clearance passage 39 and cap screw passages 46.

Figure 3:
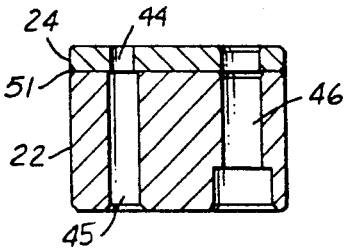
FIG. 3 is a cross-sectional view along lines 3—3 in FIG. 1.

FIG. 3 is a cross-sectional view along lines 3—3 in FIG. 1, and shows weld joint 51 integrally connecting retainer body 22 to backing plate 24. Weld joint 51 forms a bead around the periphery of punch retainer 20. Dowel passage 44 and cap screw passage 46 each extend through backing plate 24. Dowel pin clearance passage 45 is aligned with, and of a greater diameter than, dowel pin passage 44, to provide clearance.

Figure 4:
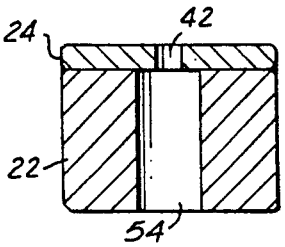
FIG. 4 is a cross-sectional view along lines 4—4 in FIG. 1.

FIG. 4 is a cross-sectional view along lines 4—4 in FIG. 1 and shows dowel pin passage 42 aligned with punch retainer passage 54. A punch is received within punch retainer passage 54 with a rear face in abutting contact with backing plate 24. When the punch is forced rearwardly into backing plate 24, the force is transmitted into backing plate 24.

Figure 5:
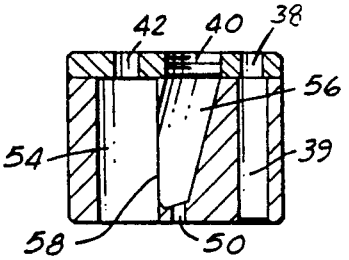
FIG. 5 is a cross-sectional view along lines 5—5 in FIG. 1.

FIG. 5 is a cross-sectional view along lines 5—5 in FIG. 1 and illustrates diamond pin passage 38 and dowel pin passage 42, which is aligned with punch retainer passage 54. Spring hole 40 is formed at one end of angled spring passage 56, which is open to punch retainer passage 54 over intersection area 58. Access hole 50 extends downwardly from spring passage 56 and provides access to release a ball received in spring passage 56. Diamond pin clearance passage 39 is aligned with, and of a greater diameter than diamond pin passage 38 to provide clearance.

Figure 6:
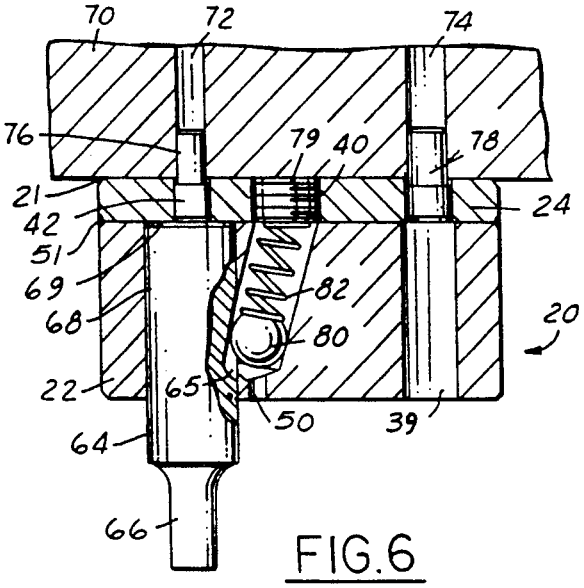
FIG. 6 is a cross-sectional view along lines 5—5 in FIG. 1, but showing the punch retainer assembled to a die shoe.

FIG. 6 shows punch retainer 20 in an assembled condition. Punch 64 is received in punch retainer passage 54, and has ball retaining notch 65. Punch tip 66 may be of a particular configuration, and may be shaped to vary around the circumference of punch 64. Punch 64 has upper cylindrical body 68 and rear face 69 in abutting contact with backing plate 24. Although punch 64 is shown closely received in punch retainer passage 54, it should be understood that a clearance actually exists.

Punch retainer 20 is mounted below punch shoe 70, which includes passages 72 and 74 to receive dowel pin 76 and diamond pin 78, respectively. Dowel pin 76 and diamond pin 78 properly position punch retainer 20 with respect to punch shoe 70, such that punch 64 is properly aligned with a bottom die shoe. Diamond pin 78 is necessary if punch tip 66 is shaped throughout its circumferential extent. If punch tip 66 is round, it may not be necessary to utilize diamond pin 78, whose primary purpose is to radially align punch 64. Seal 79 is received in spring hole 40 to seal angled spring passage 56. Ball 80 is biased by spring 82 into ball retaining notch 65 to retain punch 64 within punch retainer passage 54. Seal 79 allows a standard spring to be mounted in angled spring passage 56. Alternatively, the seal may be eliminated, and the spring can be secured within the passage either in the punch retainer body or in the backing plate. It is still necessary to have the access to the spring since the backing plate is permanently affixed to the retainer body. Thus, the spring passage passing through the entire extent of the backing plate is itself improvement over the prior art.

In typical punch and die assemblies, punch shoe 70 is moved downwardly, along with punch retainer 20, such that punch 64 is brought into contact with a metal stock, to form an aperture in the metal stock. As punch 64 contacts the metal stock, a force is transmitted rearwardly into rear face 69 of punch 64, and into backing plate 24. Since backing plate 24 extends for approximately the same area as punch retainer 20, this force is dissipated over a relatively large area. Backing plate 24 is in contact with punch shoe 70 over a relatively large surface area, and thus effectively dissipates the force and transmits it into punch shoe 70 over this surface area.

Since backing plate 24 is permanently connected to retainer body 22, it can be assured that the passage within the two are properly aligned, and that punch retainer 20 will be easily attached to die shoe 70. When forming punch retainer 20, the passages may be initially formed within retainer body 22 and backing plate 24. Backing plate 24 is then permanently connected to retainer body 22 by any permanent connecting means, such as welding or riveting. The passages are then finally ground to ensure that they are properly aligned with each other.

Seal 79, which may be a set screw or a plastic plug of some sort, is inserted into spring hole 40. Ita is important that seal 79 be easily removed to provide access to angled spring passage 56.

Punch retainer 20 is attached to die shoe 70 in a manner well known in the art. As an example cap screws may pass through cap screw passages 46. As is also well known in the art, access hole 50 allows ball 80 to be released, such that punch 64 may be attached or removed from punch retainer 20. Typically, some tool is inserted into access hole 50 to force ball 80 against the force of spring 82.

Figure 7:
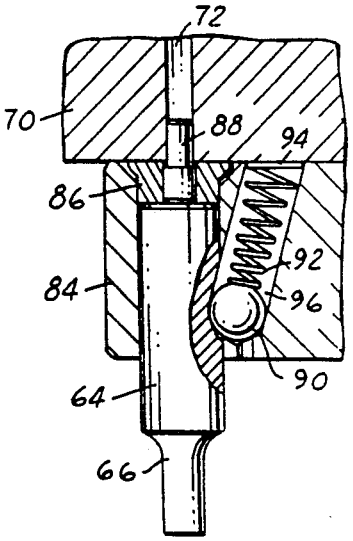
(PRIOR ART) FIG. 7
FIG. 7 is a view similar to FIG. 6, but showing a prior art punch retainer.

Prior art punch retainer 84 is illustrated in FIG. 7 for purposes of comparison. In prior art punch retainer 84, plug 86 receives the force from punch 64. Plug 86 extends for a relatively small surface area and must dissipate the force over this relatively small area. Dowel pin 88 extends through plug 86 and aligns retainer 84 with punch shoe 70. Ball 90 is biased by spring 92 into punch 64. Spring 92 is connected at 94 within passage 96 by some means. Typically, the spring must have some special attachment means to be attached within passage 96.

Punch retainer 20 of the present invention has several benefits over punch retainer 84. First, backing plate 24 extends for a much larger area than plug 86, and thus may dissipate a great deal more force. This allows it to be used in heavier applications than the prior art. In addition, sprig passage 56 of the present invention is closed off by seal 79 to allow the use of a standard spring 82. Finally, punch retainer 20 of the present invention achieves the benefits of prior art punch retainer 84, which is to eliminate complicating alignment of retainer body 22 and backing plate 24 with a die shoe.

Since punch retainer 20 is pentagonally-shaped it can be efficiently stored in large quantities. The individual punch retainers 20 nest adjacent each other to make efficient use of space.

Figure 8:
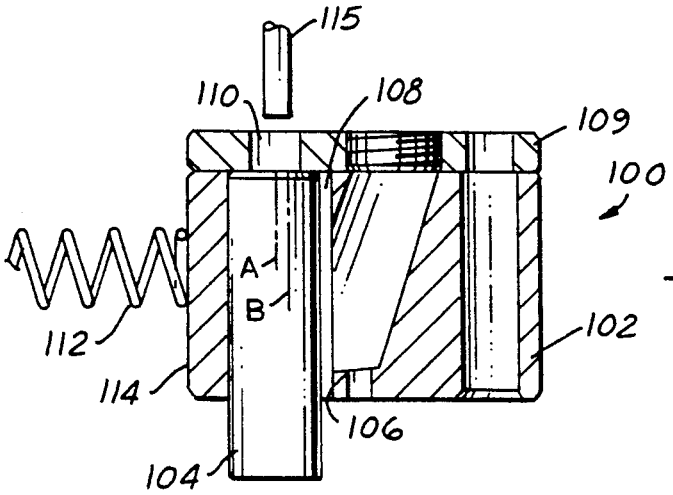
FIG. 8 is a cross-sectional partially schematic view of a apparatus for forming dowel passages in the backing plate.

A system for forming a punch retainer 100 is illustrated, largely schematically, in FIG. 8. Retainer 100 includes retainer body 102 which receives model punch 104 in punch retainer passage 106. As shown, model punch 104 has an outer diameter that is smaller than the inner diameter of punch retainer passage 106 such that there is a clearance 108. Model punch 104 is preferably selected such that its outer diameter is in the middle of the acceptable range of tolerances for the outer diameters of punches to be use din production in punch retainer 100. Backing plate 109 is preferably permanently affixed, by above-described methods, to retainer body 102 prior to its being placed on model punch 104. Dowel passage 110 passes through backing plate 109 and is aligned with punch retainer passage 106. Dowel passage 110 will be used to locate retainer 100 on an upper die shoe. This in turn locates the punch placed in punch retainer passage 100 relative to a part. Thus, it is desirable that dowel passage 110 be centered on a center line for the punch to be receive din punch retainer passage 106. In practice, however, since the outer diameter of the punch is typically smaller than the punch retainer passage 106 and there is clearance 108, the center line of the punch retainer passage 106 is somewhat offset from the center line of the punch. This results in the center line of dowel passage 110 being offset from the center line of the punch.

To address this problem the present invention disposes a spring 112, shown schematically, against a face 114 of retainer body 102. Spring 112 biases retainer body 102 towards model punch 104. Model punch 104 is thus in a position which approximates the position that a punch will be in within retainer body 102 when the punch retainer 100 is being utilized with a spring-biased ball lock, as described below.

In a method according to the present invention, grinding tool 115, shown schematically, is brought downwardly to finally bring dowel passage 110. Grinding tool 115 is controlled to center dowel passage 110 on a center line for model punch 104. Thus, when punch retainer 100 is placed on an upper die shoe and is positioned by a dowel pin in dowel passage 110, its center line position approximates the center line of the punch to be received in punch retainer passage 106. This ensures that the parts formed by the punch within the punch retainer 100 are more accurate than those formed with prior art punch retainers.

The center line of dowel passage 110 and the center line of model punch 104 are shown as line A, while the center line of punch retainer passage 106 is shown as line B. Line A is spaced slightly towards face 114 of body 102 from line B. The scale of the clearance 108 and the distance between center lines A and B may be slightly exaggerated to illustrate the point. In fact, the differences between the center lines may be on the order of thousands of an inch. Even so, this more accurate positioning of the punch provides real benefits in the accuracy of parts that are formed.

Figure 9:
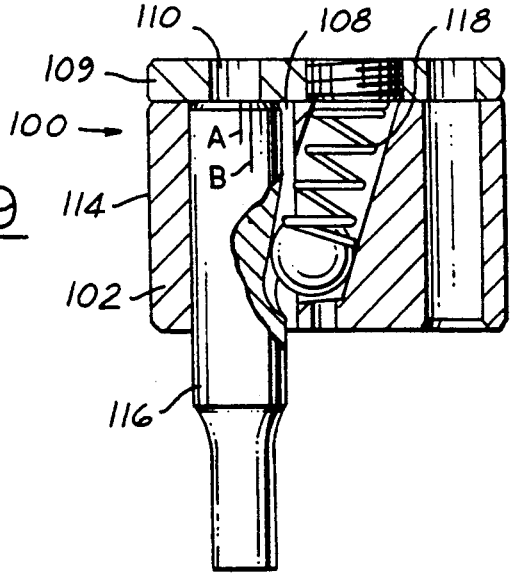
FIG. 9 is a cross-sectional view of a punch retainer formed by the method illustrated in FIG. 8.

Punch retainer 100 is shown assembled in FIG. 9. Body 102 receives punch 116. A spring-biased ball 118 forces punch 116 towards face 114. Center line A of punch 116 is approximately equal to the center line of dowel passage 110. It is possible that center line A is slightly off from the center line of dowel passage 110 due to manufacturing tolerances in the outer diameter of punch 116. Even so, the center line of dowel passage 110 is much closer to the center line A of the punch 116 than it would be if it had been formed on the center line B of the punch retainer passage 106. As such, more accurate machining of parts is achieved by punch retainer 100.

Figure 10:
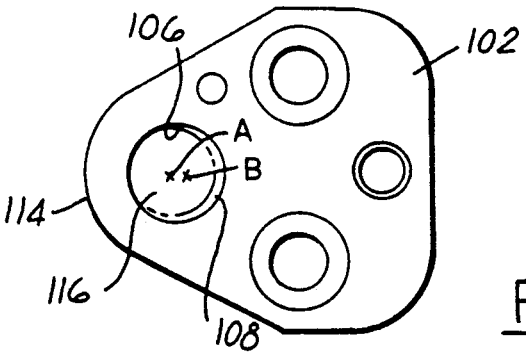
FIG. 10 is an end view of the punch retainer shown in FIG. 9.

FIG. 10 shows an end view of punch retainer 100. Center line A is shown slightly removed towards face 114 of retainer body 102 from center line B. Again, since the dowel passage 110 is centered to approximate center line A punch retainer 100 will be mounted on an upper die shoe such that it gives a more accurate positioning of the actual position of punch 116.

It should be understood that while the punch retainer 20 has been disclosed for retaining a punch, the teaching of this invention could also be used for retaining other member. In particular, the teaching could be utilized to retain a punch die, as is also disclosed in U.S. Pat. No. 3,563,124.

A preferred embodiment of the present invention has been disclosed; however, a worker of ordinary skill in the art would realize that certain modifications would be considered within the scope of this invention, and thus the following claims should be studied in order to determine the true scope and content of the present invention.

I claim:

1. A method of forming a punch retainer, comprising the steps of:

(1) permanently connecting a retainer body to a backing plate; and (2) finally grinding a passage within at least said backing plate relative to a corresponding passage in said retainer body, such that the passages in said backing plate and said retainer body are properly aligned, and wherein said passage in said backing plate is smaller than said corresponding passage formed in said retainer body.

2. A method as recited in claim 1, wherein said retainer body and said backing plate are riveted together for said permanent connection.

3. A method of forming a punch retainer comprising the steps of:

(1) permanently connecting a retainer body to a backing plate by riveting the two together to prevent movement therebetween and form a permanent connection;

(2) finally grinding a passage within said backing plate relative to a corresponding passage in said retainer body after the formation of said permanent connection such that said passages are properly aligned; and (3) inserting a punch in said corresponding passage in said retainer body.

4. A method of forming a punch retainer for holding a punch, comprising the steps of:

(1) permanently connecting a retainer body to a backing plate to form a single unit prior to a final grinding operation; and (2) finally grinding a passage within at least said backing plate relative to the axis of a punch shank located in a corresponding punch passage in said retainer body, such that the axis of the passage in said backing plate and the axis of the punch shank in the punch passage of said retainer body are properly aligned, and wherein said passage in said backing plate is smaller than the punch passage formed in said retainer body.

5. A method as recited in claim 4, wherein the step of riveting is used to connect said retainer body and said backing plate together to form said permanent connection.

6. A method as recited in claim 4, wherein the step of welding is used to connect said retainer body and said backing plate together to form said permanent connection.

7. A method as recited in claim 4, wherein the step of applying an adhesive between said retainer body and said backing plate is used to form said permanent connection.

8. A method as recited in claim 4, wherein the step of chemically bonding said retainer body and said backing plate together is used to form said permanent connection.

9. A method of forming a punch retainer for holding a punch comprising the steps of:

(1) permanently connecting a retainer body to a backing plate to prevent movement therebetween and to form a single unit prior to a final grinding operation; and (2) finally grinding a passage within said backing plate relative to the axis of a punch shank located in a corresponding punch passage in said retainer body with clearance between the shank and the punch passage such that the axis of the passage in the backing plate and the axis of the punch shank are generally coaxial and thereby properly aligned.

10. A method as recited in claim 9, wherein the step of riveting is used to connect said retainer body and said backing plate together to form said permanent connection.

11. A method as recited in claim 9, wherein the step of welding is used to connect said retainer body and said backing plate together to form said permanent connection.

12. A method as recited in claim 9, wherein the step of applying an adhesive between said retainer body and said backing plate is used to form said permanent connection.

13. A method as recited in claim 9, wherein the step of chemically bonding said retainer body and said backing plate together is used to form said permanent connection.

* * * * *

UNITED STATES PATENT AND TRADEMARK OFFICE

CERTIFICATE OF CORRECTION

PATENT NO. : 5,284,069
APPLICATION NO. : 07/990872
DATED : February 8, 1994
INVENTOR(S) : Charles G. Wellman It is certified that error appears in the above-identified patent and that said Letters Patent is hereby corrected as shown below:

Title page item notice in column, change “Jan. 26, 2010” to --May 31, 2011--.

Signed and Sealed this

Seventeenth Day of March, 2009

JOHN DOLL
*Acting Director of the United States Patent and Trademark Office*